US006112812A

United States Patent [19]

Carter

[11] Patent Number: 6,112,812

[45] Date of Patent: Sep. 5, 2000

[54] WELLBORE MILLING METHOD

[75] Inventor: Thurman B. Carter, Houston, Tex.

[73] Assignee: Weatherford/Lamb, Inc., Houston, Tex.

[21] Appl. No.: 09/003,207

[22] Filed: Jan. 6, 1998

Related U.S. Application Data

[60] Division of application No. 08/790,543, Jan. 30, 1997, Pat. No. 5,887,655, which is a continuation-in-part of application No. 08/673,791, Jun. 27, 1996, abandoned, which is a continuation-in-part of application No. 08/210,697, Mar. 18, 1994, Pat. No. 5,429,187, which is a division of application No. 08/688,651, Jul. 30, 1996, Pat. No. 5,826,651, which is a continuation-in-part of application No. 08/673,791, Jun. 27, 1996, abandoned, which is a division of application No. 08/910,735, Aug. 13, 1997, Pat. No. 5,836,387, which is a division of application No. 08/673,791, Jun. 27, 1996, abandoned.

[51] Int. Cl.[7] ..... E21B 29/06

[52] U.S. Cl. ..... 166/298

[58] Field of Search ..... 166/298, 55.1, 166/50, 117.6, 117.5; 175/403, 405.1, 402, 61, 79, 80, 81

[56] References Cited

U.S. PATENT DOCUMENTS

| | | | |
|---|---|---|---|
| 272,681 | 2/1883 | Griscom | 175/249 |
| 1,570,518 | 1/1926 | Mitchell | 166/117.6 |
| 1,589,399 | 6/1926 | Kinzbach . | |

(List continued on next page.)

FOREIGN PATENT DOCUMENTS

| | | |
|---|---|---|
| 898004 | 6/1962 | United Kingdom . |
| PCT/EP93/02504 | 9/1992 | WIPO . |

OTHER PUBLICATIONS

Oilfield Services & Manufactured Products, HOMCO, 1984–1985 Catalog, pp. 5–9.

A–Z Rotary Shoes, General Catalog, pp. 194–195, A–2 Int'l Tool Co., 1974–1975.

"Kinzbach Tool Co., Inc. Catalog 1958–1959," Kinzbach Tool Company, Inc., 1958, see pp. 3–5 paraticularly.

"Dual horizontal extension drilled using retrievable whipstock," Cress et al, Worked Oil, Jun. 1993, five pages.

"Casing Whipstocks," Eastman Whipstock, Composite Catalog, p. 2226, 1976–1977.

"Bowen Whipstocks," Bowen Oil Tools, Composite Catalog, one page, 1962–1963.

"Improved Casing Sidetrack Procedure Now Cuts Wider, Larger Windows," Cagle et al, Petroleum Engineer International, Mar. 1979.

"Weatherford Fishing and Rental tool Services," 1993.

A–1 Bit & Tool company 1990–2001 General catalog, pp. 8, 14.

Frank's, "The Submudline Drivepipe Whipstock, Patent # 4,733,732".

Int'l Search Report, PCT/EP94/02589, counterpart of this application S.N. 08/210,697.

Int'l Search Report 2nd, PCT/EP94/02589, counterpart of this application S.N. 08/210,697.

*Primary Examiner*—Hoang Dang

*Attorney, Agent, or Firm*—Guy McClung

[57] ABSTRACT

A wellbore mill has been invented which has milling apparatus with a starting mill and a finishing mill, the starting mill having a central channel extending longitudinally therethrough, the central channel having an interior surface with carbide cutters thereon. A milling method has been invented for finishing a window in a casing in a wellbore, the window having been begun with a first mill, the method including inserting a second mill apparatus into the wellbore adjacent the window, the second mill apparatus having a milling system with a starting mill and a finishing mill, the starting mill having a central channel extending longitudinally therethrough, the central channel having an interior surface with carbide cutters thereon, rotating the second mill apparatus to finish the window. A two-trip milling operation has also been invented for milling a finished window in a casing in a cased wellbore, the wellbore having installed therein an anchoring-orientation device, the operation using the wellbore mill described above. In one aspect the mill(s) mill off high center producing a piece of casing which enters into the hollow portion of the mill(s).

2 Claims, 6 Drawing Sheets

U.S. PATENT DOCUMENTS

| | | | |
|---|---|---|---|
| 1,804,819 | 5/1931 | Spencer, Jr. et al. | 166/117.6 |
| 1,812,880 | 7/1931 | Kinzbach et al. | 166/117.6 |
| 1,816,856 | 8/1931 | Kinzbach et al. | 255/1 |
| 1,866,087 | 7/1932 | Crowell . | |
| 1,869,759 | 8/1932 | Lynch . | |
| 2,014,805 | 9/1935 | Kinderliter . | |
| 2,065,896 | 12/1936 | Keever . | |
| 2,101,185 | 12/1937 | Monroe . | |
| 2,102,055 | 12/1937 | Brauer . | |
| 2,103,622 | 12/1937 | Kinzbach . | |
| 2,105,721 | 1/1938 | Carter et al. . | |
| 2,105,722 | 1/1938 | Barrett et al. | 175/81 |
| 2,170,284 | 8/1939 | Eastman | 166/117.6 |
| 2,298,706 | 10/1942 | Kothny . | |
| 2,324,682 | 7/1943 | DeLong | 166/117.6 |
| 2,331,293 | 10/1943 | Ballard | 166/117.5 |
| 2,338,788 | 1/1944 | Walker . | |
| 2,360,425 | 10/1944 | Kinzbach . | |
| 2,445,100 | 7/1948 | Wright | 166/117.6 |
| 2,495,439 | 1/1950 | Brinble | 175/81 |
| 2,509,144 | 5/1950 | Grable et al. . | |
| 2,543,861 | 3/1951 | Mader . | |
| 2,567,507 | 9/1951 | Brown | 166/117.5 |
| 2,586,878 | 2/1952 | Staton . | |
| 2,633,331 | 3/1953 | Hampton | 255/1.6 |
| 2,633,682 | 4/1953 | Jackson . | |
| 2,638,320 | 5/1953 | Condra . | |
| 2,699,920 | 1/1955 | Zublin | 166/117.6 |
| 2,731,236 | 1/1956 | Bruce | 175/405.1 |
| 2,770,444 | 11/1956 | Neal | 166/117.6 |
| 2,797,893 | 7/1957 | McCune et al. | 175/79 |
| 2,807,440 | 9/1957 | Beck | 255/1.6 |
| 2,882,015 | 4/1959 | Beck . | |
| 2,885,182 | 5/1959 | Hering | 255/1.6 |
| 2,950,900 | 8/1960 | Wynes | 175/61 |
| 2,999,541 | 9/1961 | Kinzbach et al. . | |
| 3,000,440 | 9/1961 | Malcomb | 166/4 |
| 3,055,443 | 9/1962 | Edwards . | |
| 3,075,583 | 1/1963 | Nielsen | 166/117.5 |
| 3,096,824 | 7/1963 | Brown | 166/210 |
| 3,110,084 | 11/1963 | Kinzbach . | |
| 3,172,488 | 3/1965 | Roxstrom | 175/81 |
| 3,215,215 | 11/1965 | Kellner | 175/405.1 |
| 3,283,836 | 11/1966 | North et al. | 175/405.1 |
| 3,367,430 | 2/1968 | Rowley | 175/385 |
| 3,667,252 | 6/1972 | Nelson | 64/23.5 |
| 3,908,759 | 9/1975 | Cagle et al. | 166/117.6 |
| 4,007,797 | 2/1977 | Jeter | 175/26 |
| 4,153,109 | 5/1979 | Szescila | 166/250 |
| 4,266,621 | 5/1981 | Brock | 175/329 |
| 4,285,399 | 8/1981 | Holland et al. | 166/113 |
| 4,296,822 | 10/1981 | Ormsby | 175/249 |
| 4,304,299 | 12/1981 | Holland et al. | 166/255 |
| 4,307,780 | 12/1981 | Curington | 166/113 |
| 4,397,360 | 8/1983 | Schmidt | 175/61 |
| 4,450,912 | 5/1984 | Callinan et al. | 166/289 |
| 4,491,178 | 1/1985 | Terrell et al. | 166/192 |
| 4,550,781 | 11/1985 | Kagler et al. | 166/340 |
| 4,646,826 | 3/1987 | Bailey et al. | 166/55.3 |
| 4,665,995 | 5/1987 | Braithwaite et al. | 175/45 |
| 4,844,167 | 7/1989 | Clark | 175/4.53 |
| 4,938,291 | 7/1990 | Lynde et al. | 116/55.8 |
| 4,984,488 | 1/1991 | Lynde et al. | 116/55.8 |
| 5,014,778 | 5/1991 | Lynde et al. | 166/55.6 |
| 5,035,292 | 7/1991 | Bailey et al. | 175/45 |
| 5,086,838 | 2/1992 | Cassel et al. | 166/55.6 |
| 5,109,924 | 5/1992 | Jurgens et al. | 175/61 |
| 5,113,938 | 5/1992 | Clayton | 166/117.6 |
| 5,115,872 | 5/1992 | Brunet et al. | 175/61 |
| 5,150,755 | 9/1992 | Cassel et al. | 166/55.6 X |
| 5,163,522 | 11/1992 | Eaton et al. | 175/45 |
| 5,188,190 | 2/1993 | Skaalure | 175/20 |
| 5,195,591 | 3/1993 | Blound et al. | 166/380 |
| 5,211,715 | 5/1993 | Braden et al. | 175/58 |
| 5,222,554 | 6/1993 | Blount et al. | 166/117.6 |
| 5,253,710 | 10/1993 | Carter et al. | 166/298 |
| 5,265,675 | 11/1993 | Hearn et al. | 166/297 |
| 5,277,251 | 1/1994 | Blount et al. | 166/117.5 |
| 5,287,921 | 2/1994 | Blount et al. | 166/117.6 |
| 5,287,922 | 2/1994 | Bridges | 166/277 |
| 5,318,121 | 6/1994 | Brockman | 166/313 |
| 5,318,122 | 6/1994 | Murray et al. | 166/313 |
| 5,322,127 | 6/1994 | McNair et al. | 166/313 |
| 5,335,737 | 8/1994 | Baugh | 175/61 |
| 5,341,873 | 8/1994 | Carter et al. | 166/117.5 |
| 5,346,017 | 9/1994 | Blount et al. | 166/380 |
| 5,379,845 | 1/1995 | Blount et al. | 166/382 |
| 5,655,612 | 8/1997 | Grimes et al. | 175/401 |
| 5,655,614 | 8/1997 | Azar | 175/404 |
| 5,810,079 | 9/1998 | Lynde et al. | 166/55.6 |
| 5,829,539 | 11/1998 | Newton et al. | 175/393- |

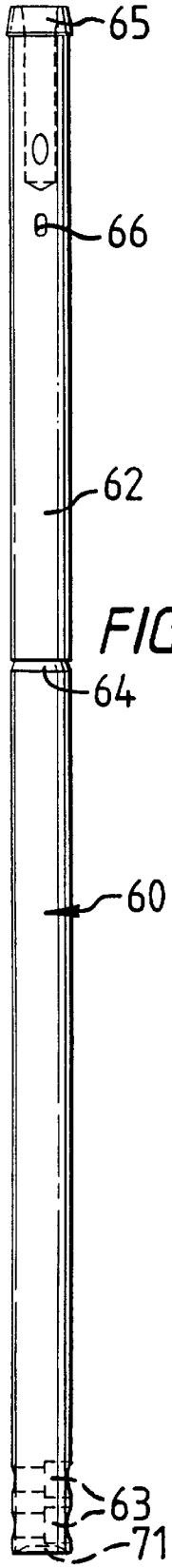
FIG. 1C
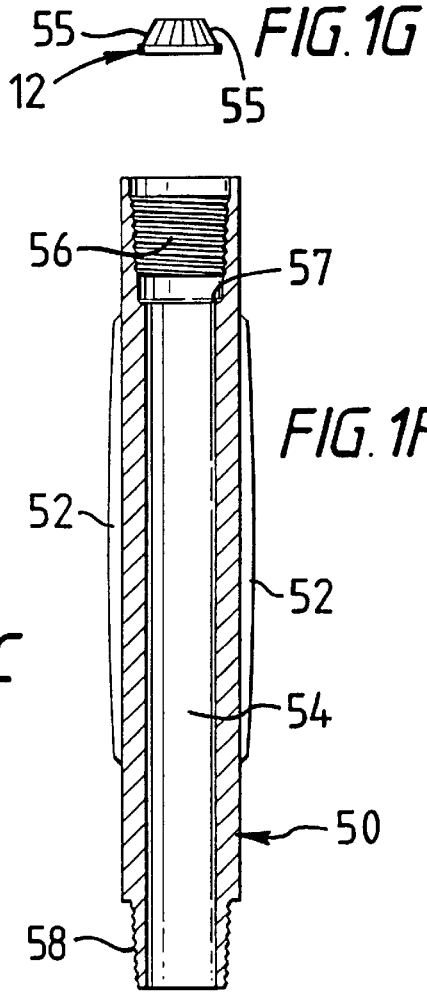
FIG. 1G
FIG. 1F
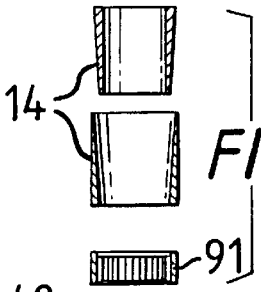
FIG. 1E
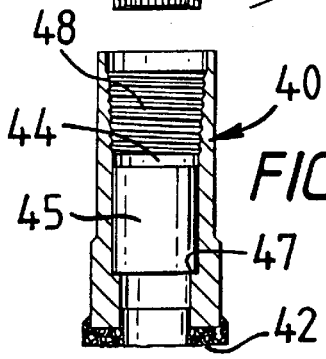
FIG. 1D
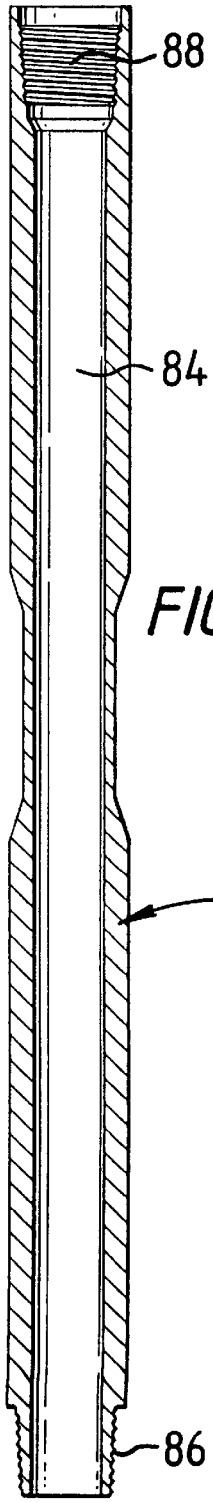
FIG. 1H

WELLBORE MILLING METHOD

RELATED APPLICATIONS

This is a division of U.S. application Ser. No. 08/790,543 filed Jan. 30, 1997 entitled "Wellbore Milling & Drilling, issued as U.S. Pat. No. 5,887,655 on Mar. 30, 1999" which is a continuation-in-part of U.S. application Ser. No. 08/673,791 filed on Jun. 27, 1996 now abandoned entitled "Wellbore Securement System," which is a continuation-in-part of U.S. application Ser. No. 08/210,697 filed on Mar. 18, 1994 entitled "Milling Tool & Operations" now U.S. Pat. No. 5,429,187 issued Jul. 4, 1995. This is a division of U.S. application Ser. No. 08/688,651 filed Jul. 30, 1996 issued as U.S. Pat. No. 5,826,651 on Oct. 27, 1998 which is also a continuation-in-part of U.S. application Ser. No. 08/673,791 filed Jun. 27, 1996 now abandoned. This is a division of U.S. application Ser. No. 08/910,735 filed Aug. 13, 1997 issued as U.S. Pat. No. 5,836,387 on Nov. 17, 1998 which is a division of U.S. application Ser. No. 08/673,791 filed Jun. 27, 1996 now abandoned. All listed applications and patents are co-owned with the present application and incorporated fully herein for all purposes.

BACKGROUND OF THE INVENTION

1. Field Of The Invention

This invention is related to milling processes, milling tools and whipstocks; and in one aspect to milling processes which employ a whipstock. In certain embodiments two-trip and single-trip milling methods and systems are disclosed.

2. Description of Related Art

Milling tools are used to cut out windows or pockets from a tubular, e.g. for directional drilling and sidetracking; and to remove materials downhole in a well bore, such as pipe, casing, casing liners, tubing, or jammed tools. The prior art discloses various types of milling or cutting tools provided for cutting or milling existing pipe or casing previously installed in a well. These tools have cutting blades or surfaces and are lowered into the well or casing and then rotated in a cutting operation. With certain tools, a suitable drilling fluid is pumped down a central bore of a tool for discharge beneath the cutting blades and an upward flow of the discharged fluid in the annulus outside the tool removes from the well cuttings or chips resulting from the cutting operation.

Milling tools have been used for removing a section of existing casing from a well bore to permit a sidetracking operation in directional drilling, to provide a perforated production zone at a desired level, to provide cement bonding between a small diameter casing and the adjacent formation, or to remove a loose joint of surface pipe. Also, milling tools are used for milling or reaming collapsed casing, for removing burrs or other imperfections from windows in the casing system, for placing whipstocks in directional drilling, or for aiding in correcting dented or mashed-in areas of casing or the like.

Prior art sidetracking methods use cutting tools of the type having cutting blades and use a deflector such as a whipstock to cause the tool to be moved laterally while it is being moved downwardly in the well during rotation of the tool to cut an elongated opening pocket, or window in the well casing.

Certain prior art well sidetracking operations which employ a whipstock also employ a variety of different milling tools used in a certain sequence. This sequence of operation requires a plurality of "trips" into the wellbore.

For example, in certain multi-trip operations, a packer is set in a wellbore at a desired location. This packer acts as an anchor against which tools above it may be urged to activate different tool functions. The packer typically has a key or other orientation indicating member. The packer's orientation is checked by running a tool such as a gyroscope indicator into the wellbore. A whipstock-mill combination tool is then run into the wellbore by first properly orienting a stinger at the bottom of the tool with respect to a concave face of the tool's whipstock. Splined connections between a stinger and the tool body facilitate correct stinger orientation. A starting mill is secured at the top of the whipstock, e.g. with a setting stud and nut. The tool is then lowered into the wellbore so that the packer engages the stinger and the tool is oriented. Slips extend from the stinger and engage the side of the wellbore to prevent movement of the tool in the wellbore. Pulling on the tool then shears the setting stud, freeing the starting mill from the tool. Rotation of the string with the starting mill rotates the mill. The starting mill has a tapered portion which is slowly lowered to contact a pilot lug on the concave face of the whipstock. This forces the starting mill into the casing to mill off the pilot lug and cut an initial window in the casing. The starting mill is then removed from the wellbore. A window mill, e.g. on a flexible joint of drill pipe, is lowered into the wellbore and rotated to mill down from the initial window formed by the starting mill. Typically then a window mill with a watermelon mill mills all the way down the concave face of the whipstock forming a desired cut-out window in the casing. This may take multiple trips. Then, the used window mill is removed and a new window mill and string mill and a watermelon mill are run into the wellbore with a drill collar (for rigidity) on top of the watermelon mill to lengthen and straighten out the window and smooth out the window-casing-open-hole transition area. The tool is then removed from the wellbore.

There has long been a need for an efficient and effective milling method in which the number of trips into the wellbore is reduced. There has long been a need for tools useful in such methods. There has long been a need for milling methods in which various items are easily and properly oriented in a wellbore. There has long been a need for tools useful in such orientation.

SUMMARY OF THE PRESENT INVENTION

The present invention, in one embodiment, discloses a well sidetracking operation which uses a tool including a whipstock with a concave face; a starting bar releasably secured to the whipstock, and in one aspect secured to the concave face; and a milling apparatus including one or more milling tools and having a central opening for receiving an end of the starting bar and a hollow interior for receiving a substantial portion of the body of the starting bar as milling proceeds, the starting bar guiding the mill(s) as the milling apparatus is moved downwardly toward the whipstock. In one embodiment the tool includes a hollow window mill mounted below a hollow finishing mill, with a hollow pup joint (e.g. fifteen feet long) connected to the finishing mill. The pup joint receives the starting bar (which has passed through the hollow mills), casing sliver and a core. A portion of the casing that enters into and is held within the pup joint and within the hollow mill(s) is an amount of casing that does not need to be and is not milled by the milling tools. In other words, as the hollow mill (or mills) with an opening in the bottom end move down, as viewed from above, there is not cutting or milling occurring at the mill(s)'s center where the opening is located; so the mill cuts two slots or lines down a side of the casing (when it is not on high center). The portion of casing between the slots or lines simply moves up into the mills and into the pup joint and the mills do not mill this portion of casing.

In one embodiment apparatus is provided for securing the starting bar to the milling apparatus so that the starting bar does not fall out of the milling apparatus once it has been received therein. For example, a retaining spring or snap ring with one or more fingers mounted in the finishing mill is disposed and configured to snap into a groove or recess on the starting bar once the starting bar has moved sufficiently into the milling apparatus (and into an interconnected hollow tubular, e.g. a pup joint) to position the groove or recess adjacent the spring or ring.

In one embodiment, a core catcher mounted between the mills is used to catch and hold a core, a piece of casing, slivers milled from the casing, and other debris so that they are removed from the wellbore when the tool is removed.

In one embodiment a packer whipstock is used in conjunction with an anchor packer and the whipstock is oriented using an orienting stinger on the bottom end thereof.

In one embodiment in which apparatus according to this invention is used in a single-trip milling method, a pin or bar extending through a hole in the top of the starting bar initially prevents the first hollow mill (lowest mill) from further pushing down around the starting bar. Initially the mill receives and holds only a top portion of the starting bar. The mill contacts and pushes against the pin so that the whipstock and associated apparatus is moved down onto the anchor packer. When milling commences, the first mill (e.g. a window mill) mills off this pin. Preferably the multiple hollow mills rotate and move down the whipstock to cut out a desired window without requiring any further tool trips into the wellbore.

In another embodiment of the present invention a two-trip milling method is disclosed in which on a first trip apparatus including a starting mill secured to a top of a whipstock concave member with a shear bolt is run into a cased wellbore. This apparatus is run into a cased wellbore to contact an anchored device such as an anchor packer. After the apparatus is anchored on the anchor device and oriented, milling commences and the starting mill, after shearing the shear bolt, mills out an initial pocket in the casing. The starting mill is then removed. For the second trip into the wellbore, a tool as previously described including everything above the starting bar (but without a starting bar) is run into the wellbore and used as previously described, swallowing an unmilled portion of the casing and other material.

It is, therefore, an object of at least certain preferred embodiments of the present invention to provide:

New, useful, unique, efficient, non-obvious milling tools, whipstocks, and devices and methods for milling operations;

A milling method requiring a reduced number of trips, preferably one or two trips, into a wellbore to create a desired window in a tubular in the wellbore;

A milling method in which a window is milled at a desired location in a casing;

A tool useful in any of the methods described or listed herein;

A whipstock with an orientation member or starting bar for guiding a milling apparatus;

A milling apparatus with a hole or receptacle for receiving a whipstock's orientation member or starting bar; and in one aspect such apparatus which continuously receives such orientation apparatus as milling proceeds;

Such milling apparatus with which milling is not conducted on high center of a tubular or casing so that the entire circumference of the casing need not be milled and so that only a part of the portion milled is actually contacted by the milling surfaces and a resulting unmilled portion of casing is swallowed within the apparatus;

Such milling apparatus with one or more mills; and

Such milling apparatus with a device for releasably securing a starting bar or other orientation member thereto.

This invention resides not in any particular individual feature disclosed herein, but in combinations of them and it is distinguished from the prior art in these combinations with their structures and functions. There has thus been outlined, rather broadly, features of the invention in order that the detailed descriptions thereof that follow may be better understood, and in order that the present contributions to the arts may be better appreciated. There are, of course, additional features of the invention that will be described hereinafter and which may be included in the subject matter of the claims appended hereto. Those skilled in the art who have the benefit of this invention will appreciate that the conceptions, upon which this disclosure is based, may readily be utilized as a basis for the designing of other structures, methods and systems for carrying out the purposes of the present invention. It is important, therefore, that the claims be regarded as including any legally equivalent constructions insofar as they do not depart from the spirit and scope of the present invention.

The present invention recognizes and addresses the previously-mentioned problems and needs and provides a solution to those problems and a satisfactory meeting of those needs in its various possible embodiments and equivalents thereof. To one of skill in this art who has the benefits of this invention's realizations, teachings and disclosures, other and further objects and advantages will be clear, as well as others inherent therein, from the following description of presently-preferred embodiments, given for the purpose of disclosure, when taken in conjunction with the accompanying drawings. Although these descriptions are detailed to insure adequacy and aid understanding, this is not intended to prejudice that purpose of a patent which is to claim an invention as broadly as legally possible no matter how others may later disguise it by variations in form or additions of further improvements.

DESCRIPTION OF THE DRAWINGS

So that the manner in which the above-recited features, advantages and objects of the invention, as well as others which will become clear, are attained and can be understood in detail, more particular description of the invention briefly summarized above may be had by references to certain embodiments thereof which are illustrated in the appended drawings, which drawings form a part of this specification. It is to be noted, however, that the appended drawings illustrate certain preferred embodiments of the invention and are therefore not to be considered limiting of its scope, for the invention may admit to other equally effective or equivalent embodiments.

FIG. 1A–1H are side views of parts of a milling system according to the present invention. FIGS. 1D–1H are in cross-section.

DESCRIPTION OF EMBODIMENTS PREFERRED

Figure 1A:
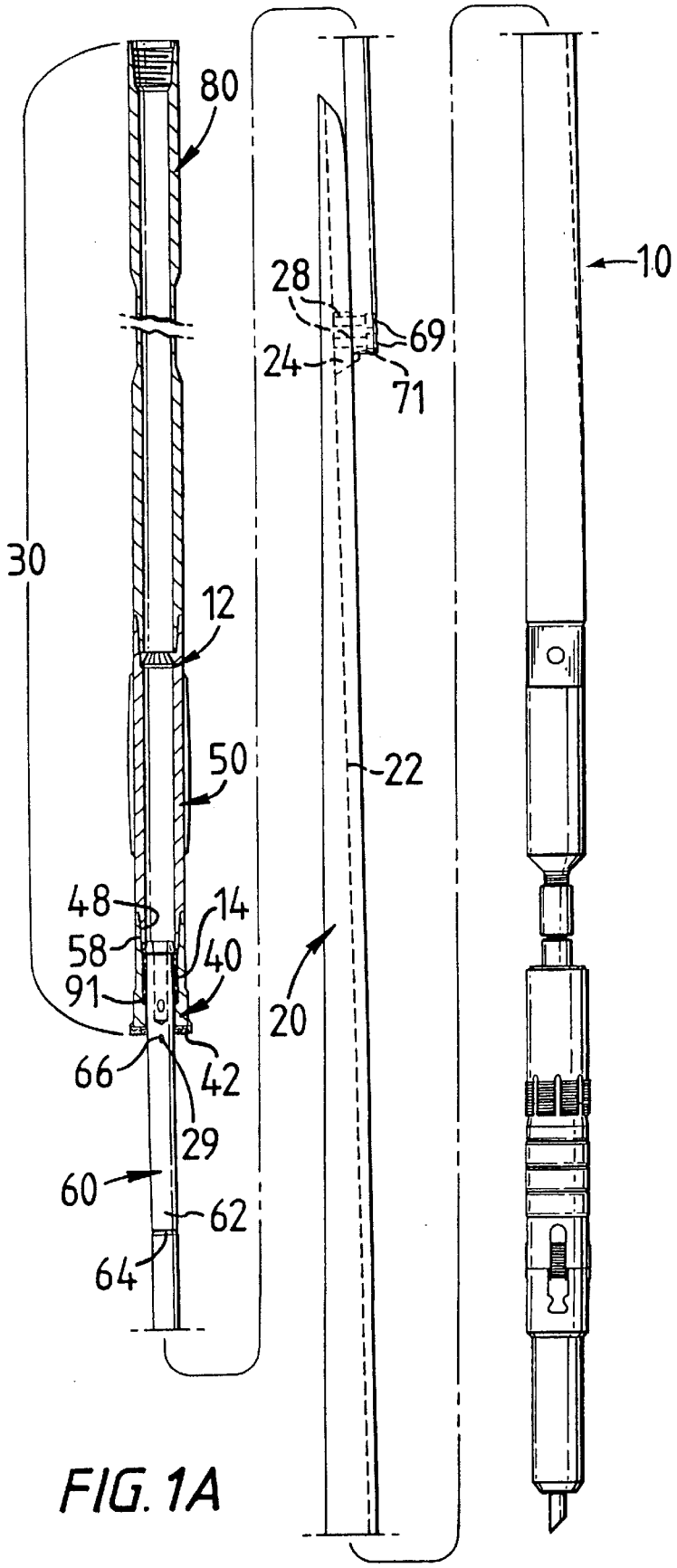
Figure 1B:
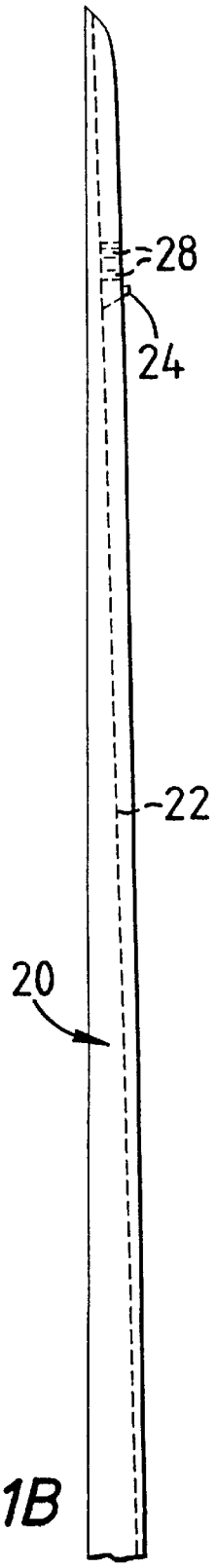

Referring now to FIGS. 1A–1H and 2A and 2B, a tool 10 according to the present invention has a whipstock 20 according to the present invention with a pilot block 24 welded near a top 26 thereof. The whipstock has a concave face 22. The pilot block 24 has bolt holes 28.

The tool 10 has a starting bar 60 which has a body 62 which is secured to the whipstock 20 by bolts 69 through holes 63 extending into holes 28 in the pilot block 24. A groove 64 encircles the body 62. A stop bar 29 (see FIG. 4) extends through a stop pin hole 66.

The tool 10 has the milling apparatus 30 which includes at least one and preferably two or more mills so that a milling operation for producing a sidetracking window in casing can be accomplished in a dual or single tool trip into a cased wellbore. As shown in FIGS. 1 and 2, the milling apparatus 30 includes a starting mill 40 connected to and below a hollow finishing mill 50. Interior threads 48 of the starting mill 40 engage exterior threads 58 of the finishing mill 50.

The starting mill 40 has a central channel 44 therethrough and a cutting end with carbide cutters 42. A core catcher 14 is disposed within the starting mill 40 and rests on a shoulder 47 to receive and hold debris such as an initial casing sliver, etc. The core catcher 14 is a typical two-piece core catcher.

The finishing mill 50 has a plurality of milling blades 52 and a central channel 54 therethrough. A retainer 12 is disposed within the channel 54 and rests on a shoulder 57 of the mill 50. The retainer 12, as shown in FIG. 1G, preferably is a spring with a plurality of fingers 55 which are disposed so that the fingers 55 protrude into the groove 64 of the starting bar 60, preventing the starting bar 60 from moving downwardly from the position shown in FIG. 4.

To accommodate a substantial portion of the starting bar 60 when its length exceeds that of the combined lengths of the mill(s), a pup joint may be used such as the pup joint 80. External threads 86 on the lower end of the pup joint 80 engage upper internal threads 56 of the finishing mill 50. Upper internal threads 88 of the pup joint engage a part of a drill string (not shown) e.g. a crossover sub with a mud motor above it. A central channel 84 extends through the pup joint and is sized and configured to receive a portion of the starting bar 60.

Figure 2A:
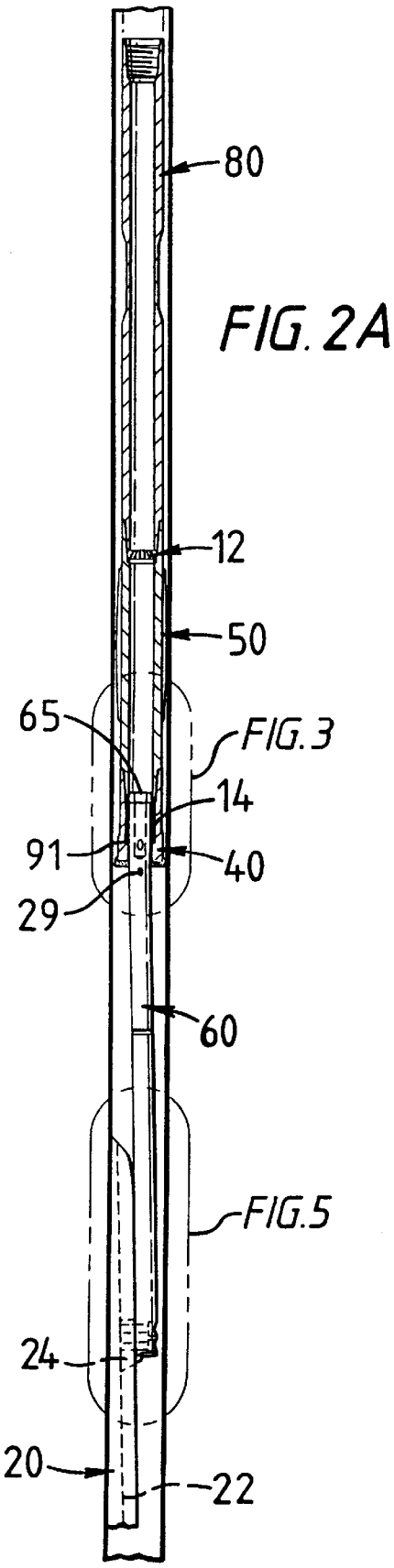
FIGS. 2A and 2B show the milling system including the parts shown in FIGS. 1A–1H and show steps in the operation of the system.
Figure 2B:
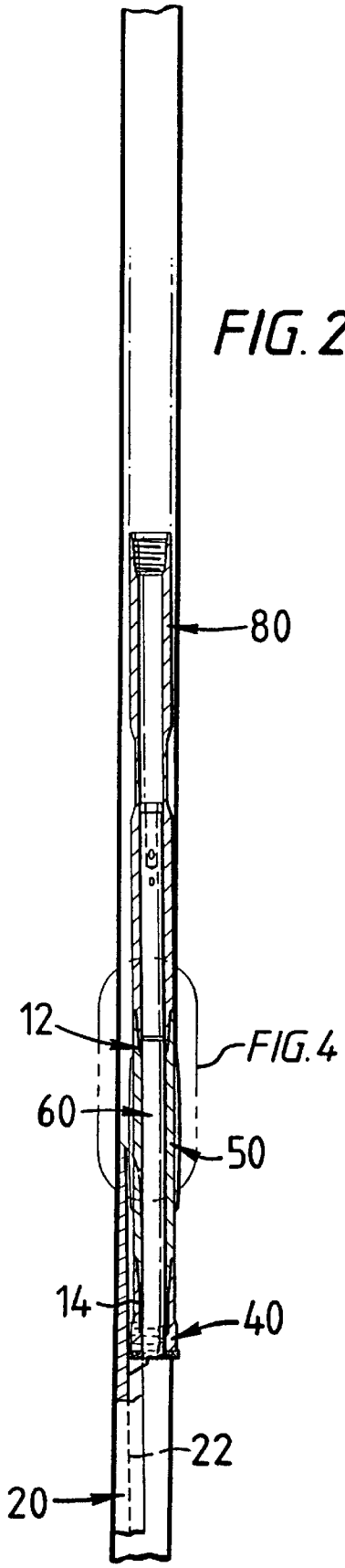
Figure 3:
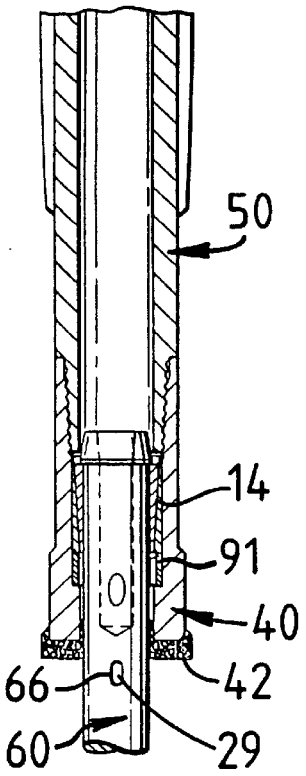
FIG. 3 is an enlarged view of part of the tool show in FIG. 2A.

FIGS. 2A and 2B illustrate steps in the use of a tool 10 according to this invention. As shown in FIG. 2A, the milling apparatus 30 has a top portion 65 of the starting bar 60 within the starting mill 40 and the starting bar 60 is secured to the whipstock 20. As shown in FIG. 2B the starting mill 40 and apparatus above it have pushed down on the bar 29, breaking it, and permitting the milling apparatus 30 to receive a substantial portion of the starting bar 60. The starting mill 40 has moved to contact the pilot block 24 and mill off the bar 29.

Figure 4:
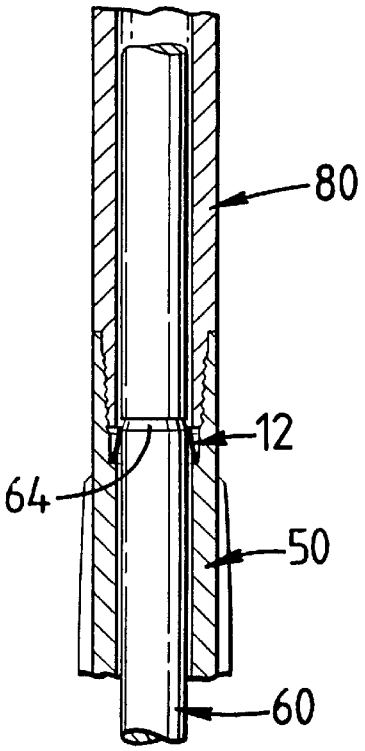
FIG. 4 is an enlarged view of a part of the tool shown in FIG. 2B.
Figure 7:
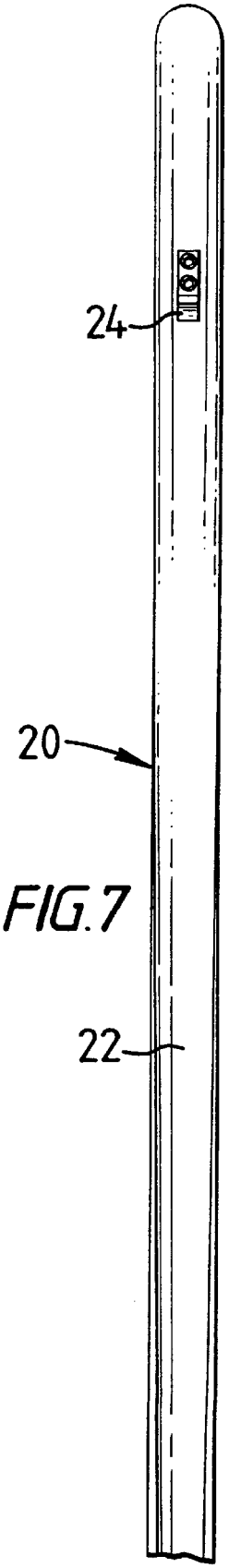
FIG. 7 is a side view of the whipstock concave member of the tool of FIG. 2A
Figure 5:
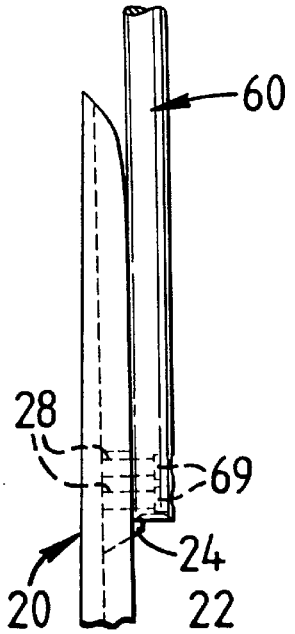
FIG. 5 is an enlarged view of a portion of the tool of FIG. 2A.
Figure 6:
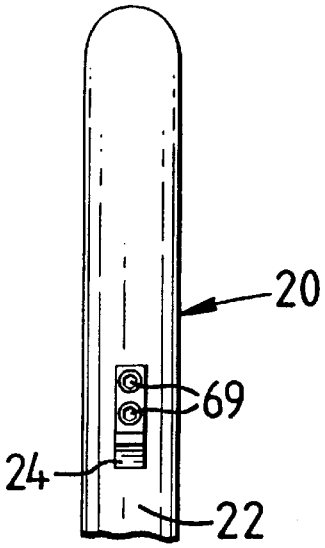
FIG. 6 is a side view of the tool as shown in FIG. 5.
Figure 8:
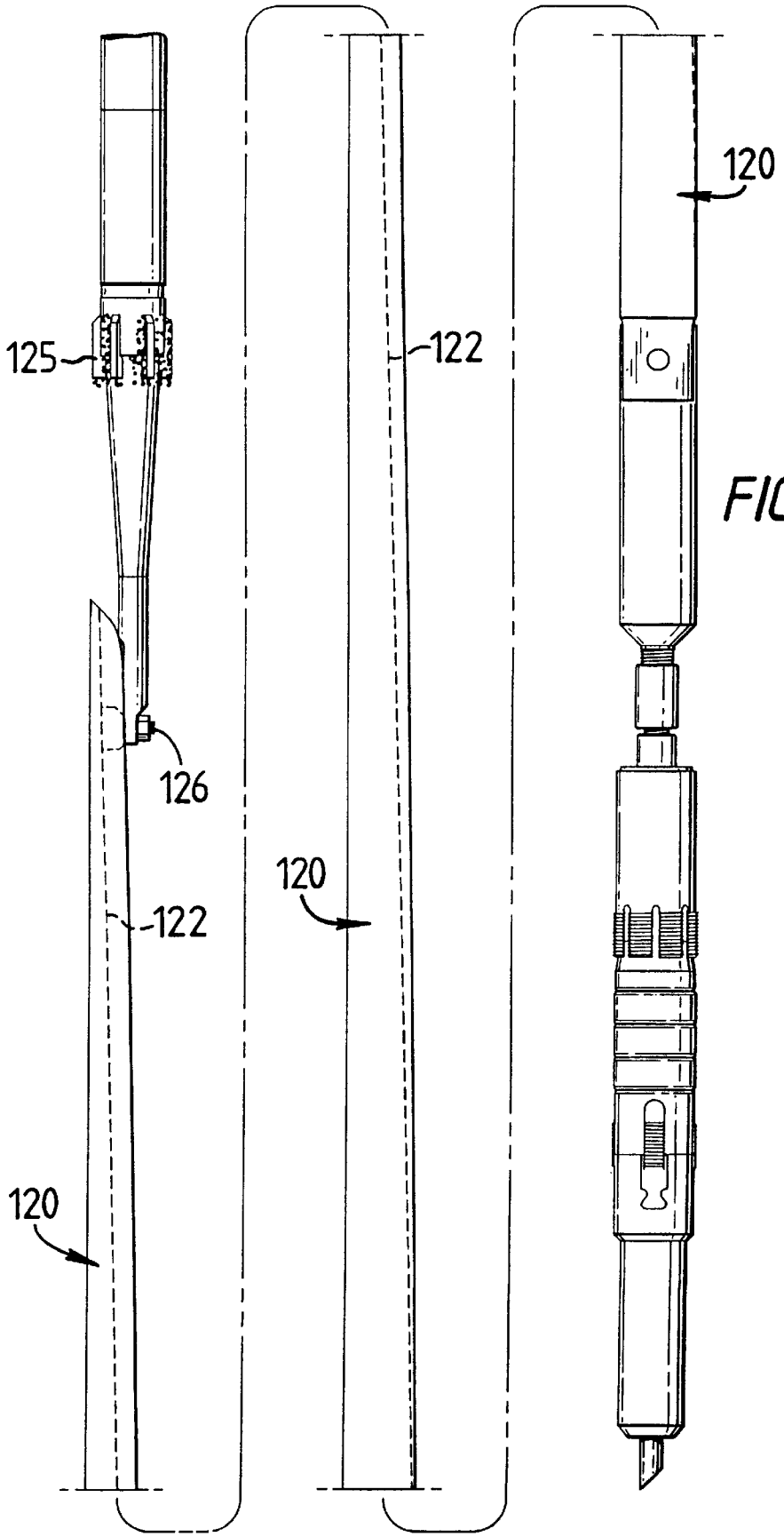
FIG. 8 is a side view of apparatus according to the present invention.

Milling now commences and the starting mill 40 mills through the pilot block 24. As the starting mill moves down the concave face of the concave member 20, the concave member 20 is moved sideways in the casing (add casing to FIGS. 2A, 2B) (to the left in FIGS. 2A and 2B) and a window is begun in the casing's interior wall. As shown in FIG. 4 the fingers 55 have entered the groove 64, preventing the starting bar 60 from falling out of the apparatus or from being pumped out by circulating well fluid. The starting bar 60 has an indented end 71 to facilitate entry of a core into the mill.

To move cutting and debris out of the wellbore a circulation fluid is, preferably, circulated downhole through the drill pipe, outside of and past the starting bar between the starting bar's exterior and the mills' interiors, past the core catcher, past a splined bearing 91, past the starting mill between its exterior and the casing's interior and back up to the surface.

As the milling apparatus mills down against the concave member, the finishing mill 50 smooths the transition from the casing edge to the wellbore to complete the milling operation. Then the milling apparatus is removed from the wellbore with the starting bar 60, casing sliver, debris, and core held within the interior of the mills.

Figure 9A:
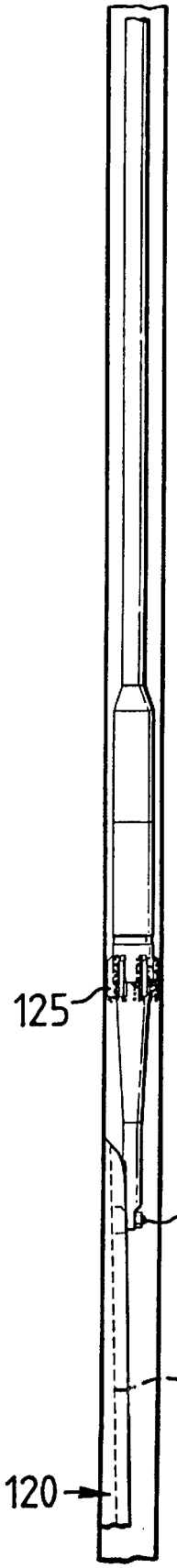
FIG. 9A is a side view of apparatus used in a method according to the present invention.
Figure 9B:
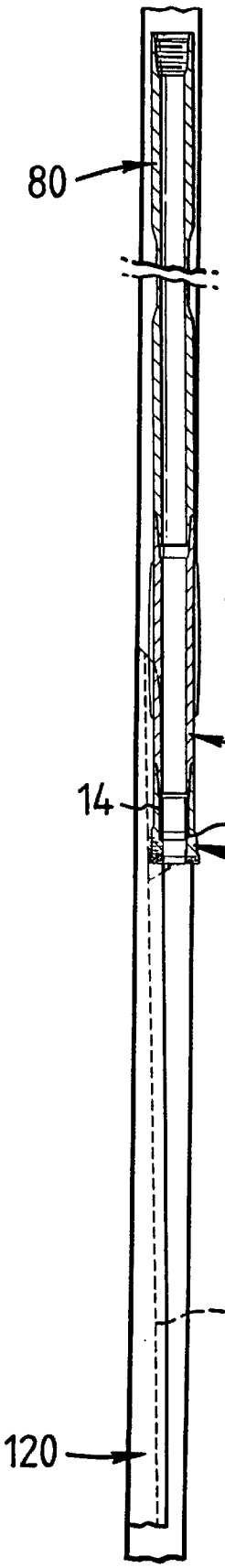
FIG. 9B is a side view of apparatus used in a method according to the present invention.

As shown in FIGS. 9A and 9B, in a two-trip milling operation according to the present invention, a tool 120 including a whipstock concave member 122 and a starting mill 125 secured thereto with a sheer stud 126 is run into a cased wellbore in which some type of anchoring-orientation device, e.g. a keyed packer (not shown), has been installed. Upon emplacement and orientation of the tool 120, the shear stud 126 is sheared by pushing down on the tool and milling is commenced producing an initial window or pocket in the casing. The tool 120 is removed leaving the whipstock concave member 122 in place and then a milling system (like the system shown in FIG. 2B) is run into the hole to continue milling at the location of the initial window or pocket. This milling system includes the items above the starting bar 60 in FIG. 2A, but not the starting bar 60; and the milling system, as shown in FIG. 9B, is used as previously described but without the starting bar. This two-trip operation results in a finished window through the casing.

In conclusion, therefore, it is seen that the present invention and the embodiments disclosed herein and those covered by the appended claims are well adapted to carry out the objectives and obtain the ends set forth. Certain changes can be made in the described and in the claimed subject matter without departing from the spirit and the scope of this invention. It is realized that changes are possible within the scope of this invention and it is further intended that each element or step recited in any of the following claims is to be understood as referring to all equivalent elements or steps. The claims that follow have an effective filing date of Mar. 18, 1994. The following claims are intended to cover the invention as broadly as legally possible in whatever form its principles may be utilized.

What is claimed is:

1. A milling method for making a window through a casing in a wellbore, the method comprising inserting a milling system with at least a first mill and a second mill interconnected together into the wellbore adjacent a desired location for a window through the casing, the first mill comprising a starting mill and the second mill comprising a finishing mill, the starting mill having lower cutting end and a central channel extending longitudinally therethrough from top to bottom, the central channel at the lower cutting end of the starting mill having an interior surface with carbide cutters thereon, rotating the milling system to make the window, and making the window in a single trip into the wellbore.

2. The milling method of claim 1 wherein a whipstock is positioned in the wellbore adjacent the desired location for the window, and the method further comprising urging the finishing mill against the whipstock, the whipstock in turn urging the finishing mill against the casing.

* * * * *